US010001018B2

(12) United States Patent
Kvasnak et al.

(10) Patent No.: US 10,001,018 B2
(45) Date of Patent: Jun. 19, 2018

(54) HOT GAS PATH COMPONENT WITH IMPINGEMENT AND PEDESTAL COOLING

(71) Applicant: General Electric Company, Schenectady, NY (US)

(72) Inventors: William Stephen Kvasnak, Simpsonville, SC (US); Scott Edmond Ellis, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1035 days.

(21) Appl. No.: 14/063,131

(22) Filed: Oct. 25, 2013

(65) Prior Publication Data

US 2015/0118013 A1 Apr. 30, 2015

(51) Int. Cl.

| | |
|---|---|
| ***F01D 5/18*** | (2006.01) |
| ***F01D 25/12*** | (2006.01) |
| ***F23M 5/08*** | (2006.01) |
| ***F23R 3/00*** | (2006.01) |

(52) U.S. Cl.

CPC ..... *F01D 5/188* (2013.01); *F01D 5/187* (2013.01); *F01D 25/12* (2013.01); *F23M 5/085* (2013.01); *F23R 3/005* (2013.01); *F05D 2260/201* (2013.01); *F05D 2260/204* (2013.01); *F05D 2260/2214* (2013.01); *F23R 2900/03041* (2013.01); *F23R 2900/03045* (2013.01)

(58) Field of Classification Search

CPC ..... F01D 5/188; F01D 5/189; F01D 9/065; F01D 25/12; F01D 5/187; F23R 3/005; F23R 2900/03041; F23R 2900/03045; F23M 5/085; F05D 2260/201; F05D 2260/204; F05D 2260/2214

USPC ..... 415/115, 116; 416/1

See application file for complete search history.

(56) References Cited

U.S. PATENT DOCUMENTS

| | | | | | |
|---|---|---|---|---|---|
| 3,628,880 | A | * | 12/1971 | Smuland | F01D 5/189 415/115 |
| 3,800,864 | A | * | 4/1974 | Hauser | F01D 25/12 165/186 |
| 4,105,364 | A | * | 8/1978 | Dodd | F01D 5/189 415/115 |
| 4,695,247 | A | * | 9/1987 | Enzaki | F23R 3/002 431/351 |

(Continued)

FOREIGN PATENT DOCUMENTS

| | | | | |
|---|---|---|---|---|
| CN | 102444431 | A | | 5/2012 |
| CN | 102454428 | A | | 5/2012 |
| JP | 56072201 | A | * | 6/1981 |

OTHER PUBLICATIONS

First Office Action and Search issued in connection with corresponding CN Application No. 201410573615.3 dated Dec. 27, 2016.

*Primary Examiner* — Igor Kershteyn

(74) *Attorney, Agent, or Firm* — Eversheds Sutherland (US) LLP

(57) ABSTRACT

The present application provides a hot gas path component for use in a hot gas path of a gas turbine engine. The hot gas path component may include an internal wall, an external wall facing the hot gas path, an impingement wall, a number of internal wall pedestals positioned between the internal wall and the impingement wall, and a number of external wall pedestals positioned between the external wall and the impingement wall.

20 Claims, 3 Drawing Sheets

(56) References Cited

U.S. PATENT DOCUMENTS 5,328,331 A * 7/1994 Bunker ..... F01D 5/187 415/115
5,363,654 A * 11/1994 Lee ..... F23R 3/002 165/908
5,391,052 A * 2/1995 Correia ..... F01D 11/10 415/115
5,591,002 A * 1/1997 Cunha ..... F01D 5/187 415/115
6,139,269 A 10/2000 Liang
6,170,266 B1 * 1/2001 Pidcock ..... F23R 3/06 60/755
6,196,799 B1 3/2001 Fukue et al.
6,261,054 B1 * 7/2001 Bunker ..... F01D 5/187 415/115
6,435,814 B1 8/2002 Yu et al.
6,478,540 B2 11/2002 Abuaf et al.
7,097,418 B2 * 8/2006 Trindade ..... F01D 5/18 415/115
7,198,467 B2 4/2007 Keith et al.
7,255,536 B2 8/2007 Cunha et al.
7,465,154 B2 12/2008 Devore et al.
7,488,156 B2 * 2/2009 Liang ..... F01D 5/186 416/96 R
7,597,533 B1 * 10/2009 Liang ..... F01D 9/02 415/116
8,015,817 B2 * 9/2011 Charron ..... F01D 9/023 60/39.37
8,360,726 B1 * 1/2013 Liang ..... F01D 5/187 416/241 R
8,388,300 B1 * 3/2013 Liang ..... F01D 11/08 415/1
8,500,401 B1 * 8/2013 Liang ..... F01D 5/186 415/1
8,684,664 B2 * 4/2014 Harris, Jr. ..... F01D 5/081 29/889.721
8,920,110 B2 * 12/2014 Anguisola McFeat . F01D 5/186 415/115
2007/0116562 A1 5/2007 West et al.
2010/0034638 A1 2/2010 Chambers et al.
2010/0266410 A1 10/2010 Amaral et al.
2012/0082548 A1 4/2012 Ellis et al.
2012/0121415 A1 5/2012 Brittingham et al.
2012/0156055 A1 6/2012 Harris, Jr. et al.
2012/0195743 A1 8/2012 Walunj et al.
2012/0201653 A1 * 8/2012 Moga ..... F01D 5/147 415/115
2013/0052009 A1 2/2013 Smith et al.
2013/0115090 A1 5/2013 Ellis et al.
2013/0230394 A1 9/2013 Ellis et al.

* cited by examiner

HOT GAS PATH COMPONENT WITH IMPINGEMENT AND PEDESTAL COOLING

TECHNICAL FIELD

The present application and the resultant patent relate generally to gas turbine engines and more particularly relate to a hot gas path component such as a turbine bucket platform with combined impingement cooling and pedestal cooling for improved efficiency and component lifetime.

BACKGROUND OF THE INVENTION

Known gas turbine engines generally include rows of circumferentially spaced nozzles and buckets. A turbine bucket includes an airfoil having a pressure side and a suction side and extending radially upward from a platform. A hollow shank portion may extend radially downward from the platform and may include a dovetail and the like so as to secure the turbine bucket to a turbine wheel. The platform generally defines an inner boundary for the hot combustion gases flowing through the hot gas path. As such, the platform may be an area of high stress concentrations due to the hot combustion gases and the mechanical loading thereon. In order to relieve a portion of the thermally induced stresses, a turbine bucket may include some type of platform cooling scheme or other arrangements so as to reduce the temperature differential between the top and the bottom of the platform.

Various types of platform cooling schemes are known. For example, impingement cooling is well-known in, for example, stage one nozzle cooling schemes. Due to the fact that most of the pressure drop across an impingement cooling circuit is taken across an impingement plate, however, either the impingement holes generally must be relatively small or the cooling circuit may require more flow to manage the pressure than may be required by the overall cooling requirements. Other types of platform cooling examples include the use of pedestal cooling. Pedestal cooling is known in, for example, stage one bucket trailing edges and the like. Other types of hot gas path components also may require similar types of cooling.

There is therefore a desire for an improved hot gas path component such as a turbine bucket and the like for use with a gas turbine engine. Preferably such a turbine bucket may provide cooling to the platform and other components thereof without excessive cooling medium losses for efficient operation and an extended component lifetime.

SUMMARY OF THE INVENTION

The present application and the resultant patent thus provide a hot gas path component for use in a hot gas path of a gas turbine engine. The hot gas path component may include an internal wall, an external wall facing the hot gas path, an impingement wall, a number of internal wall pedestals positioned between the internal wall and the impingement wall, and a number of external wall pedestals positioned between the external wall and the impingement wall for combined pedestal cooling and impingement cooling.

The present application and the resultant patent further provide a method of cooling a hot gas path component in a hot gas path of a gas turbine engine. The method may include the steps of flowing a cooling medium through an internal wall pedestal cooling zone having a number of internal wall pedestals, flowing the cooling medium though an impingement cooling zone having a number of impingement holes, and flowing the cooling medium through an external wall pedestal cooling zone having a number of external wall pedestals for combined pedestal cooling and impingement cooling.

The present application and the resultant patent further provide a bucket platform for use in a hot gas path of a gas turbine engine. The bucket platform may include an internal wall, an external wall facing the hot gas path, an impingement wall with a number of impingement holes therein, a number of internal wall pedestals positioned between the internal wall and the impingement wall, and a number of external wall pedestals positioned between the external wall and the impingement wall for combined pedestal cooling and impingement cooling.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
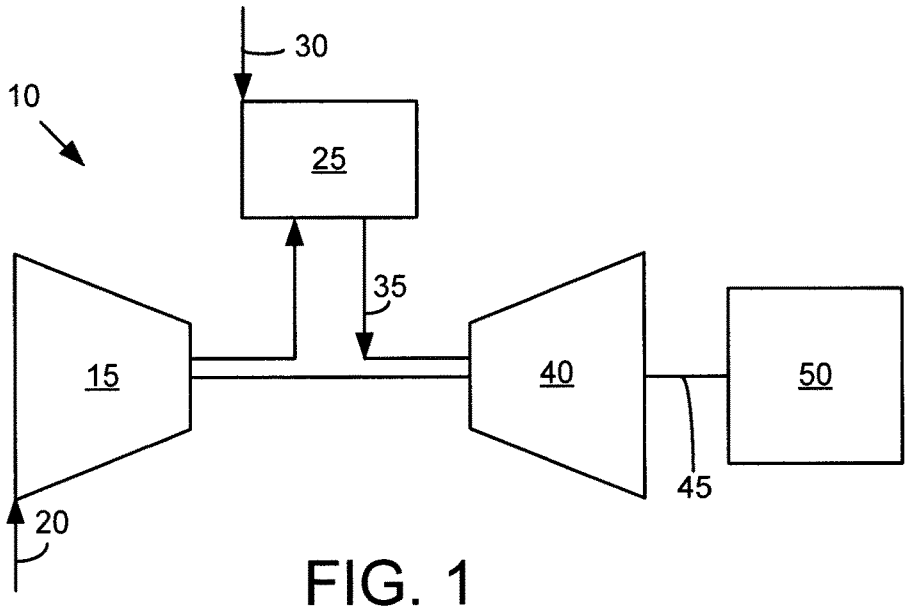
FIG. 1 is a schematic diagram of a gas turbine engine with a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, liquid fuel, various types of syngas, and/or other types of fuels and blends thereof. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together. Aviation application also may be used herein.

Figure 2:
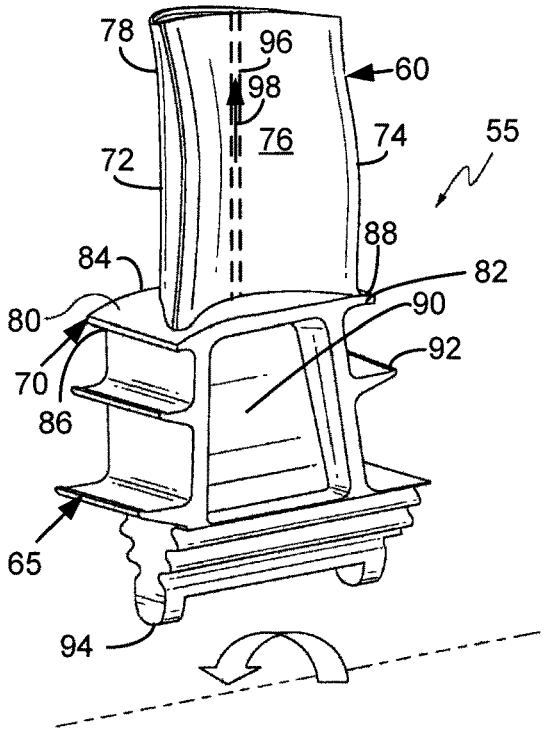
FIG. 2 is a perspective view of a turbine bucket with an airfoil extending from a platform.

FIG. 2 shows an example of a turbine bucket 55 that may be used with the turbine 40. Generally described, the turbine bucket 55 includes an airfoil 60, a shank portion 65, and a platform 70 disposed between the airfoil 60 and the shank portion 65. The airfoil 60 generally extends radially upward from the platform 70 and includes a leading edge 72 and a trailing edge 74. The airfoil 60 also may include a concave wall defining a pressure side 76 and a convex wall defining a suction side 78. The platform 70 may be substantially horizontal and planar. Likewise, the platform 70 may include a top surface 80, a pressure face 82, a suction face 84, a forward face 86, and an aft face 88. The top surface 80 of the platform 70 may be exposed to the flow of the hot combustion gases 35. The shank portion 65 may extend radially downward from the platform 70 such that the platform 70 generally defines an interface between the airfoil 60 and the shank portion 65. The shank portion 65 may include a shank cavity 90 therein. The shank portion 65 also may include one or more angle wings 92 and a root structure 94 such as a dovetail and the like. The root structure 94 may be configured to secure the turbine bucket 55 to the shaft 45.

The turbine bucket 55 may include one or more cooling circuits 96 extending therethrough for flowing a cooling medium 98 such as air from the compressor 15 or from another source. The cooling circuits 96 and the cooling medium 98 may circulate at least through portions of the airfoil 60, the shank portion 65, and the platform 70 in any order, direction, or route. Many different types of cooling circuits and cooling mediums may be used herein. The turbine bucket 55 described herein is for the purpose of example only, many other components and other configurations also may be used herein.

Figure 3:
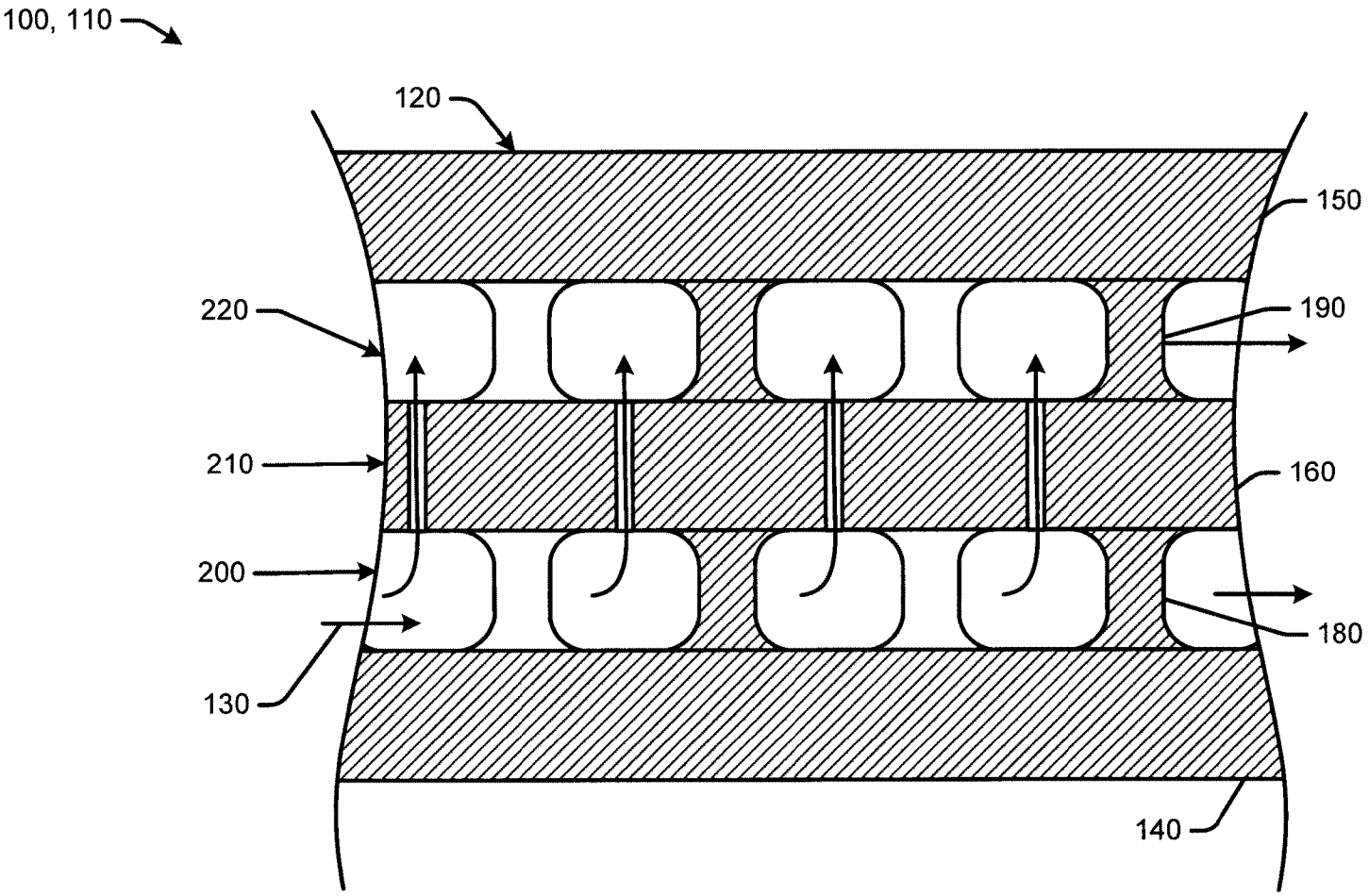
FIG. 3 is a side cross-sectional view of a portion of a platform of a turbine bucket as may be described herein.
Figure 4:
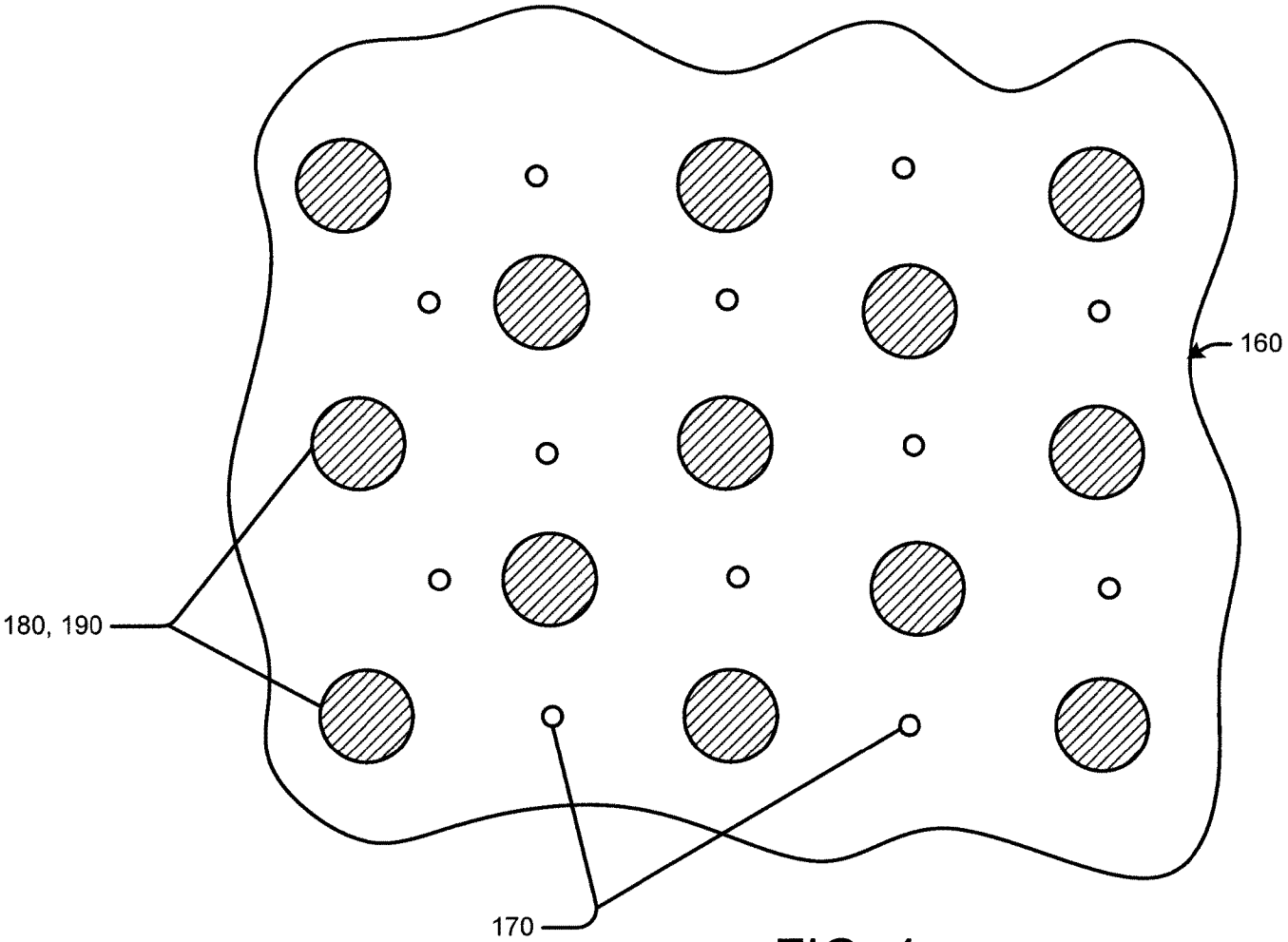
FIG. 4 is a top cross-sectional view of a portion of the platform of FIG. 3 showing the impingement holes and the pedestals.

FIG. 3 and FIG. 4 show a portion of a hot gas path component 100 as may be described herein. In this example, the hot gas path component 100 may be a turbine bucket 110. More specifically, the hot gas path component 100 may be a bucket platform 120. The turbine bucket 110 and the platform 120 may be similar to that described above. The platform 120 may be cooled with a cooling medium 130. Any type of cooling medium 130 may be used herein from any source. Other types of hot gas path components may be used herein. For example, the hot gas path component 100 may include a nozzle, a shroud, a liner, and/or a transition piece. The hot gas path component 100 may have any size, shape, or configuration. The hot gas path component 100 may be made out of any suitable type of heat resistant materials.

The platform 120 may include an internal wall 140. The internal wall 140 may be on the cool side of the platform 120. The platform 120 also may include an external wall 150. The external wall 150 may be on the top surface or the hot side of the platform 120 in the hot gas path formed by the flow of combustion gases 35. The platform 120 may further include a middle impingement wall 160. The walls 140, 150, 160 may have any size, shape, or configuration.

The impingement wall 160 may include an array of impingement holes 170 therethrough. The impingement holes 170 may have any size, shape, or configuration. Any number of the impingement holes 170 may be used. The internal wall 140 may be connected to the impingement wall 160 by a number of internal wall pedestals 180. Likewise, the external wall 150 may be connected to the impingement wall 160 via a number of external wall pedestals 190. The pedestals 180, 190 may have any size, shape, or configuration. Any number of pedestals 180, 190 may be used. Other components and other configurations may be used herein.

In use, the cooling medium 130 may flow through the interior wall pedestals 180 between the internal wall 140 and the impingement wall 160 in an internal wall pedestal cooling zone 200. The internal wall pedestals 180 may promote an even distribution of the cooling medium 130 therein so as to enhance the heat transfer rate, conduct heat from the impingement wall 160 to the internal wall 149, and distribute stress from the impingement wall 160 to the internal wall 140. The cooling medium 130 then may flow through the impingement holes 170 of the impingement wall 160 in the form of an impingement cooling zone 210. The cooling medium 130 may flow through the impingement wall 160 in the form of a number of impingement jets so as to provide enhanced backside heat transfer with respect to the external wall 150. The cooling medium 130 then may flow through the external wall pedestals 190 between the impingement wall 160 and the external wall 150 in the form of an external wall pedestal cooling zone 220. The cooling medium 130 flowing through the external wall pedestals 190 may promote an even distribution of the cooling medium 130 therein so as to enhance the heat transfer rate, conduct heat from the external wall 150 to the impingement wall 160, and distributes stress from the external wall 150 to the impingement wall 160.

The platform 120 described herein thus may reduce the cooling medium requirements for improved gas turbine output and efficiency as well as overall service benefits. The platform 120 or other type of hot gas path component 100 provides high convective cooling with structural integrity through the combination of the pedestal cooling zones 200, 220 and the impingement zone 210. Specifically, the platform 120 combines the benefits of the thermal stress distribution of the pedestal cooling zones 200, 220 with the higher heat transfer characteristics of the impingement cooling zone 210. The overall pressure drop therein may be managed in that the platform 120 takes one-third of the pressure drop across the internal wall pedestal cooling zone 200, one-third of the pressure drop across the impingement cooling zone 210, and one-third of the pressure drop across the external wall pedestal cooling zone 220. Likewise, the pedestal cooling zones 200, 220 may redistribute the thermal stresses therein for an improved component life cycle. Although the hot gas path component 100 has been described in the context of the bucket 110 and the platform 120, any type of hot gas component, including a nozzle, a shroud, a liner, a transition piece, and the like may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A hot gas path component for use in a hot gas path of a gas turbine engine, comprising:

an internal wall formed as a continuous solid member;

an external wall formed as a continuous solid member and facing the hot gas path;

an impingement wall comprising a plurality of impingement holes therethrough;

a plurality of internal wall pedestals positioned between the internal wall and the impingement wall and arranged in an array such that the internal wall pedestals are spaced apart from one another in a first direction and a second direction transverse to the first direction; and a plurality of external wall pedestals positioned between the external wall and the impingement wall and arranged in an array such that the external wall pedestals are spaced apart from one another in the first direction and the second direction;

wherein the internal wall pedestals and the external wall pedestals are aligned with one another in the first direction and the second direction;

wherein the internal wall and the impingement wall define an internal wall pedestal cooling zone therebetween;

wherein the external wall and the impingement wall define an external wall pedestal cooling zone therebetween; and wherein the internal wall pedestal cooling zone is in fluid communication with the external wall pedestal cooling zone via the impingement holes.

2. The hot gas path component of claim 1, wherein the hot gas path component comprises a bucket.

3. The hot gas path component of claim 1, wherein the hot gas path component comprises a platform.

4. The hot gas path component of claim 1, wherein the impingement holes each have a circular cross-sectional shape.

5. The hot gas path component of claim 1, wherein the internal wall pedestals and the external wall pedestals each have a circular cross-sectional shape.

6. The hot gas path component of claim 1, wherein the impingement wall defines an impingement cooling zone.

7. The hot gas path component of claim 1, wherein the internal wall, the external wall, and the impingement wall each have a planar shape and are arranged parallel to one another.

8. The hot gas path component of claim 1, further comprising a cooling medium flowing about the plurality of internal wall pedestals, the impingement wall, and the plurality of external wall pedestals.

9. The hot gas path component of claim 8, wherein the cooling medium comprises a plurality of impingement jets flowing through the impingement wall.

10. The hot gas path component of claim 1, wherein the hot gas path component comprises a nozzle, a shroud, a liner, and/or a transition piece.

11. A method of cooling a hot gas path component in a hot gas path of a gas turbine engine, comprising:

flowing a cooling medium through an internal wall pedestal cooling zone defined between an internal wall and an impingement wall of the hot gas path component and having a plurality of internal wall pedestals positioned therein, wherein the internal wall is formed as a continuous solid member, and wherein the internal wall pedestals are arranged in an array such that the internal wall pedestals are spaced apart from one another in a first direction and a second direction transverse to the first direction;

flowing the cooling medium from the internal wall pedestal cooling zone though an impingement cooling zone defined by the impingement wall and having a plurality of impingement holes; and flowing the cooling medium from the impingement cooling zone through an external wall pedestal cooling zone defined between an external wall of the hot gas path component and the impingement wall and having a plurality of external wall pedestals positioned therein, wherein the external wall is formed as a continuous solid member, wherein the external wall pedestals are arranged in an array such that the external wall pedestals are spaced apart from one another in the first direction and the second direction, and wherein the internal wall pedestals and the external wall pedestals are aligned with one another in the first direction and the second direction.

12. The method of claim 11, further comprising the step of conducting heat from the impingement wall through the plurality of internal wall pedestals to the internal wall.

13. The method of claim 11, further comprising the step of distributing stress from the impingement wall through the plurality of internal wall pedestals to the internal wall.

14. The method of claim 11, wherein the step of flowing the cooling medium through the impingement cooling zone comprises increasing heat transfer on the external wall.

15. The method of claim 11, further comprising the steps of conducting heat and distributing stress from the external wall through the plurality of external wall pedestals to the impingement wall.

16. A bucket platform for use in a hot gas path of a gas turbine engine, comprising:

an internal wall formed as a continuous solid member;

an external wall formed as a continuous solid member and facing the hot gas path;

an impingement wall comprising a plurality of impingement holes therethrough;

a plurality of internal wall pedestals positioned between the internal wall and the impingement wall and arranged in an array such that the internal wall pedestals are spaced apart from one another in a first direction and a second direction transverse to the first direction; and a plurality of external wall pedestals positioned between the external wall and the impingement wall and arranged in an array such that the external wall pedestals are spaced apart from one another in the first direction and the second direction;

wherein the internal wall pedestals and the external wall pedestals are aligned with one another in the first direction and the second direction;

wherein the internal wall and the impingement wall define an internal wall pedestal cooling zone therebetween;

wherein the external wall and the impingement wall define an external wall pedestal cooling zone therebetween; and wherein the internal wall pedestal cooling zone is in fluid communication with the external wall pedestal cooling zone via the impingement holes.

17. The bucket platform of claim 16, wherein the internal wall, the external wall, and the impingement wall each have a planar shape and are arranged parallel to one another.

18. The bucket platform of claim 16, wherein the impingement wall defines an impingement cooling zone.

19. The bucket platform of claim 16, wherein the impingement holes are spaced apart from the internal wall pedestals and the external wall pedestals.

20. The bucket platform of claim 16, further comprising a cooling medium flowing about the plurality of internal wall pedestals, the impingement wall, and the plurality of external wall pedestals.

* * * * *